US006905563B2

(12) United States Patent
Dong

(10) Patent No.: US 6,905,563 B2
(45) Date of Patent: Jun. 14, 2005

(54) METHOD AND APPARATUS FOR MELT-BLOWN FIBER ENCAPSULATION

(75) Inventor: Daojie Dong, Westerville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 101 days.

(21) Appl. No.: 10/328,964

(22) Filed: Dec. 24, 2002

(65) Prior Publication Data

US 2004/0118506 A1 Jun. 24, 2004

(51) Int. Cl.[7] ..... B32B 19/06; B32B 5/26; B32B 31/30

(52) U.S. Cl. ..... 156/62.4; 156/167; 156/279; 428/74; 428/76

(58) Field of Search ..... 156/62.4, 167, 156/279; 428/74, 76

(56) References Cited

U.S. PATENT DOCUMENTS

| | | | | |
|---|---|---|---|---|
| 2,211,309 A | | 8/1940 | Zimmerman | |
| 3,955,031 A | * | 5/1976 | Jones et al. | 442/412 |
| 4,315,721 A | | 2/1982 | Sorenson | |
| 4,675,225 A | * | 6/1987 | Cutler | 428/74 |
| 4,878,258 A | * | 11/1989 | Casey | 5/420 |
| 4,891,249 A | | 1/1990 | McIntyre | |
| 5,501,872 A | | 3/1996 | Allen et al. | |
| 5,582,905 A | * | 12/1996 | Beck et al. | 428/74 |
| 5,679,042 A | | 10/1997 | Varona | |
| 5,733,624 A | | 3/1998 | Syme et al. | |
| 5,746,854 A | | 5/1998 | Romes et al. | |
| 5,879,615 A | | 3/1999 | Syme et al. | |
| 5,900,298 A | | 5/1999 | Syme et al. | |
| 6,135,747 A | | 10/2000 | Syme et al. | |
| 6,203,646 B1 | * | 3/2001 | Gundberg et al. | 156/167 |
| 6,579,586 B1 | * | 6/2003 | Fay et al. | 428/40.1 |

FOREIGN PATENT DOCUMENTS

| | | | |
|---|---|---|---|
| CA | 2211309 | 7/1997 | |
| WO | WO 9316874 A1 * | 9/1993 | B32B/5/26 |

* cited by examiner

*Primary Examiner*—Sam Chuan Yao
(74) *Attorney, Agent, or Firm*—Inger H. Eckert; Maria C. Gasaway

(57) ABSTRACT

The invention relates to an insulation product comprising an elongated fibrous batt with at least a partial polymeric encapsulating layer formed by melt-blowing or melt spraying a polymeric composition onto one or more surfaces of the fibrous batt and, optionally, a separate vapor retarding layer applied to one or more surfaces of the fibrous batt and an apparatus for manufacturing such an insulation product.

11 Claims, 9 Drawing Sheets

METHOD AND APPARATUS FOR MELT-BLOWN FIBER ENCAPSULATION

TECHNICAL FIELD AND INDUSTRIAL APPLICABILITY OF THE INVENTION

This invention relates to fibrous insulation products, and in particular those insulation products of the type suitable for insulating buildings. More specifically, this invention pertains to insulation products having an encapsulating layer and, optionally, a vapor barrier, for improving the handling characteristics and reducing dust and fiber generation in the resulting insulation products.

BACKGROUND OF THE INVENTION

Fibrous insulation is typically manufactured by fiberizing a molten composition of polymer or other minerals to form fine fibers and depositing the fibers on a collecting conveyor. Although mineral fibers, such as glass fibers, are typically used in insulation products, depending on the particular application organic fibers, such as polypropylene and polyester may be used singly or in combination with mineral fibers. Most fibrous insulation products also incorporate a binder composition to bond the fibers together where they contact each other within the batt or sheet to form a lattice or network. This lattice structure provides improved resiliency that allows the insulation product to recover a substantial portion of its thickness after being compressed and also provides improved stiffness and handleability. During the manufacturing process the insulation products are typically formed and cut to provide sizes generally compatible with standard construction practices. During actual installation of the insulation products, workers will typically cut or trim the standard products for the specific installation.

One typical insulation product is an insulation batt, usually about 8 feet (2.4 m) long sized for use as wall insulation in residential dwellings, or as insulation in the attic and floor insulation cavities in buildings. The width of insulation batts designed for wall cavities is set to typical insulation cavity widths, such as about 15 inches (38 cm) or 23 inches (58 cm) to accommodate standard U.S. stud spacings of 16 and 24 inches (41 and 61 cm), respectively. Some insulation products also incorporate a facing material on at least one of the major surfaces. In many cases the facing material is provided as a vapor barrier, while in other insulation products, such as binderless products, the facing material improves the product integrity.

Insulation products incorporating a vapor barrier are commonly used to insulate wall, floor or ceiling cavities that separate a warm moist space, typically the living spaces, from a cold space, typically the exterior, crawl space, or ground. In such applications, the vapor barrier is preferably placed to prevent warm moist air from diffusing toward the cold space where it would cool and condense within the insulation. Such a situation would result in a damp insulation product that cannot perform at its designed efficiency and cause a loss in insulation value (R-Value). In predominately warm moist climates, however, it is not uncommon to reverse the typical installation in order to prevent vapor from entering the insulation cavity and approaching an air conditioned space.

There are, however, some applications that require an insulation product that does not incorporate or provide a vapor barrier, but rather allows water vapor to pass through fairly readily. For example, insulation products designed and intended for installation over existing attic insulation should not include a vapor barrier. Similarly, insulation products for wall cavities that have a separate full wall vapor barrier, such as a polyethylene film, applied over the insulation product.

A number of methods for encapsulating fibrous batts for improved handling properties are known. For example, U.S. Pat. No. 5,277,955 to Schelhom et al. discloses an encapsulated batt in which the encapsulation material is adhered to the batt with an adhesive that can be applied in longitudinal stripes, or in patterns such as dots, or in an adhesive matrix. The Schelhorn patent also discloses that an alternative method of attachment is for the adhesive layer to be an integral part of the encapsulation film, which, when softened, bonds to the fibers in the batt and is hereby incorporated, in its entirety, by reference.

U.S. Pat. No. 5,733,624 to Syme et al. discloses a mineral fiber batt impregnated with a coextruded polymer layering system, and U.S. Pat. No. 5,746,854 to Romes et al. discloses a method for impregnating a mineral fiber batt with a coextruded film in which at least the coextruded film is heated before being applied to the fiber batt. The heat energy necessary to achieve the necessary degree of heating may be transferred primarily by conduction the coextruded film passes over a heated cylinder or through radiant infrared heaters. Attaching the coextruded film in this manner has some disadvantages in that the particular heating process cannot be abruptly terminated or quickly varied due to the large thermal mass provided by the heated cylinder. In addition, the heated cylinder does not provide a means for selectively heating portions of the coextruded film to different temperatures. These patents are hereby incorporated, in their entirety, by reference.

Many traditional vapor barriers for insulation products comprised a layer of asphalt covered with a layer of Kraft paper or a foil facing material. The asphalt layer was generally applied in molten form, covered with the facing material and pressed against the fibrous insulation material as it was cooled to bond the facing material to the fibrous batt. Although the asphalt and Kraft paper system is relatively inexpensive, the asphalt/Kraft combination layer tends to be relatively stiff and may slow the installation process by requiring more precise fitting. Further, during cold weather installations, cutting the facing without tearing the Kraft paper may be difficult because the asphalt becomes brittle. Conversely, during warm weather installations, the asphalt material can become sticky and foul the cutting tool.

U.S. Pat. No. 6,357,504 to Patel et al. provided an alternative means for attaching a facing layer to a fibrous batt in which the facing comprises a coextruded polymer film including both a barrier layer and a bonding layer, with the bonding layer having a softening point lower than the softening point of the barrier layer. The bonding layer could comprise a range of materials including ethylene N-butyl acrylate, ethylene methyl acrylate ethylene ethyl acrylate, low density polyethylene (LDPE) and ethylene vinyl acetate, both singularly and in combination. Accordingly, when the facing is heated to a temperature above the softening point of the bonding layer, but below the softening point of the barrier layer, the facing may be adhered to the batt as the bonding layer attaches to the fibers. This patent is hereby incorporated, in its entirely, by reference.

In addition to facing layers provided on one or more surfaces of a fibrous batt, some prior art applications provide for an encapsulating layer to improve the tactility of the insulation product during the handling and mounting, reduce or eliminate the release of fibers before, during or after mounting and improved tensile strength. One such method is disclosed in U.S. Pat. No. 6,203,646 to Gundberg et al. in which the encapsulating layer is formed directly on the surface of the fiber batt by forming a thermoplastic polymer melt distributing fibers formed from the polymer melt onto the fiber batt. In this method, the adhesive characteristics of the molten and partially molten thermoplastic polymers is used to adhere the layer to the underlying fibers without the use of any additional binder or adhesive composition. This patent is hereby incorporated, in its entirety, by reference.

Another method and apparatus for providing a melt blown encapsulating layer on a fiber batt is provided in U.S. Pat. No. 5,501,872 to Allen et al. in which a six-sided fibrous batt is coated with a nonwoven polymeric material by passing the batt sequentially through three coating stations. Four sides of the batt are coated in the first two stations and, after the batt is turned 90°, the final two sides are coated to completely encapsulate the batt in a fibrous nonwoven coating layer. This patent is hereby incorporated, in its entirety, by reference.

There still, however, remains a need for improved methods for encapsulating insulation products to enhance their handling and performance encapsulation methods.

SUMMARY OF THE INVENTION

The invention is directed, in part, to an insulation product comprising an elongated fibrous batt with a polymeric encapsulating layer and, optionally, a vapor barrier layer on one or more surfaces of the fibrous batt. The invention is also, in part, directed to an apparatus for manufacturing an insulation product comprising an elongated fibrous batt with a polymeric encapsulating layer and, optionally, a vapor barrier layer. The invention is also, in part, directed to a method of making an insulation product comprising an elongated fibrous batt with a polymeric encapsulating layer and, optionally, a vapor barrier layer.

The foregoing and other objectives of the present invention will become more apparent from the detailed description provided below. However, it should be understood that the detailed description and specific examples, while indicating preferred embodiments of the invention, are given by way of illustration only, and that various changes and modifications within the spirit and scope of the invention will be apparent to those skilled in the art when guided by the detailed disclosure.

BRIEF DESCRIPTION OF THE DRAWINGS

The present invention may be more fully understood from the detailed description provided below and by reference to the accompanying figures. These figures are provided by way of illustration only and do not, therefore, operate to limit the present invention as detailed by the accompanying claims.

The appended drawings are intended as illustrative only and are not necessarily drawn to a consistent scale and should not be taken to exclude auxiliary equipment and processes in a coating operation according to the present invention.

DETAILED DESCRIPTION AND PREFERRED EMBODIMENTS

While the description and drawings refer generally to insulation products of comprising a glass fiber insulation material, it is to be understood that the insulation material can be any compressible fibrous insulation material, such as rock wool, polypropylene or polyester.

According to the present invention, a polymeric skin layer is applied to three or four sides of an insulation batt, typically a fiber glass batt, using a melt blowing process to produce an irritation free insulation product. A range of polymer materials may be applied to the fiber batt, including one or more of polypropylene (PP), polyethylene (PE), polyethylene terephthalate (PET), nylon or other suitable thermoplastic material. Low molecular weight, high melt flow index (MFI) polypropylene is especially preferred.

Once formed, the encapsulating "skin" layer shields handlers from irritation resulting from contact with the fiber batt and functions as an integral part of the glass insulation product. In one embodiment, the resulting product may be partially encapsulated by the melt-blown skin layer with a manufactured PE film separately applied to a major surface of the batt to act as a vapor retarder (VR) to form a "faced" insulation product. If a hot melt glue is used to adhere the PE film to the fiber batt, the glue is preferably applied in a discontinuous pattern and at a rate sufficiently low that the resulting insulation product will still have a low organic content and pass the ASTM E-84 fire test.

Figure 1:
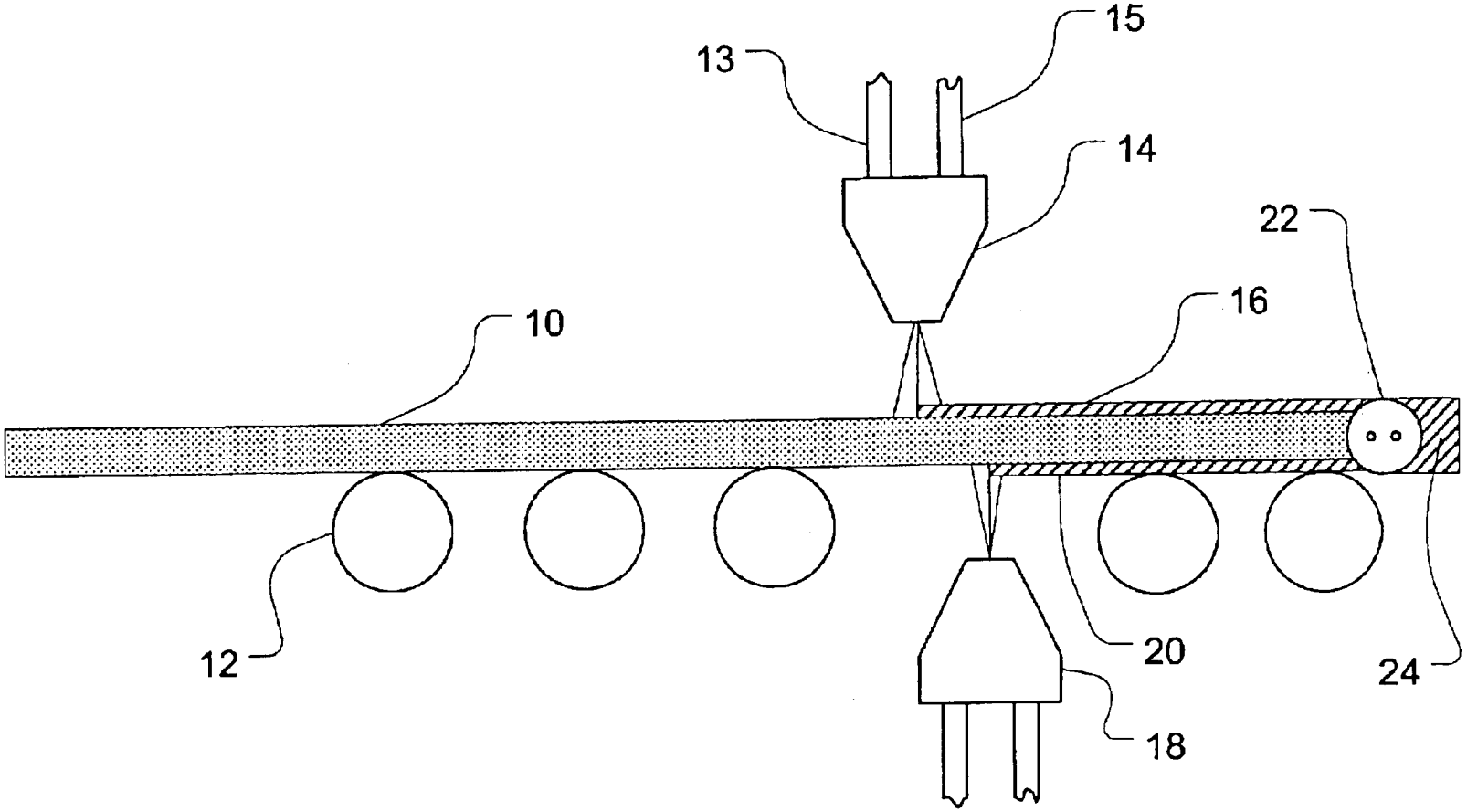
FIG. 1 is a side view illustrating certain components in a first embodiment of an apparatus for manufacturing an encapsulated fiber batt.

As illustrated in FIG. 1, a continuous glass fiber batt 10 is prepared by collecting glass fibers, coating them with a binder composition, and then drying and curing the binder. The fiber batt is then moved across a series of rollers 12 and/or belts or other conveyors so that a surface of the fiber batt passes near a first melt blowing head 14. Supply lines 13, 15 provide both a blowing gas and a polymeric melt to the first melt blowing head so that as the fiber batt passes near the melt blowing head a layer of melt blown polymeric fibers 16 can be deposited on the surface of the fiber batt. As the fiber batt proceeds, it passes near additional melt blowing heads 18, 22 arranged and configured to apply additional layers of polymeric fibers 20, 24 to other surfaces of the fiber batt and form a substantially continuous encapsulating layer around the fiber batt.

The polymer composition used in the melt blowing process may be held in a reservoir as pellets or granules and conveyed to a screw extruder or other device that can melt and optionally blend the polymer composition to produce the polymeric melt. This polymeric melt is then delivered in a controlled or metered manner to the melt blowing heads for deposition onto the fiber batt. The blowing gas, typically heated air, is delivered to the melt blowing heads through a separate system that provides gas of sufficient volume, velocity and temperature to attenuate the stream of polymeric melt and form polymer fibers. It is preferred that all the components through which the polymeric melt will flow are heated and/or sufficiently well insulated to prevent premature solidification of the melt within the apparatus and to ensure that as the polymeric melt is ejected from the melt blowing head its viscosity is sufficiently low to allow effective fiberization by the blowing gas. The polymeric composition used may contain other ingredients for adjusting the performance and/or appearance of the resulting skin layer. For example, pigment may be added to the coating composition to produce a pink skin layer.

As will be appreciated, the order in which the various surfaces of the fiber batt 10 are coated may be altered and multiple surfaces may be coated simultaneously while still achieving the desired degree of encapsulation. Similarly, depending on the dimensions of the fiber batt, one or more melt blowing heads may be aligned in a direction generally perpendicular to the direction of travel of the fiber batt for coating a single surface. A sequence of melt blowing heads may also be arranged along the direction of travel of the fiber batt for applying a sequence of thin coatings to achieve the desired thickness for the encapsulating layer. Similarly, it is possible to vary the thickness and/or the composition of the coating applied to different surfaces of the fiber batt to adjust the properties of the resulting insulation product.

Figure 2:
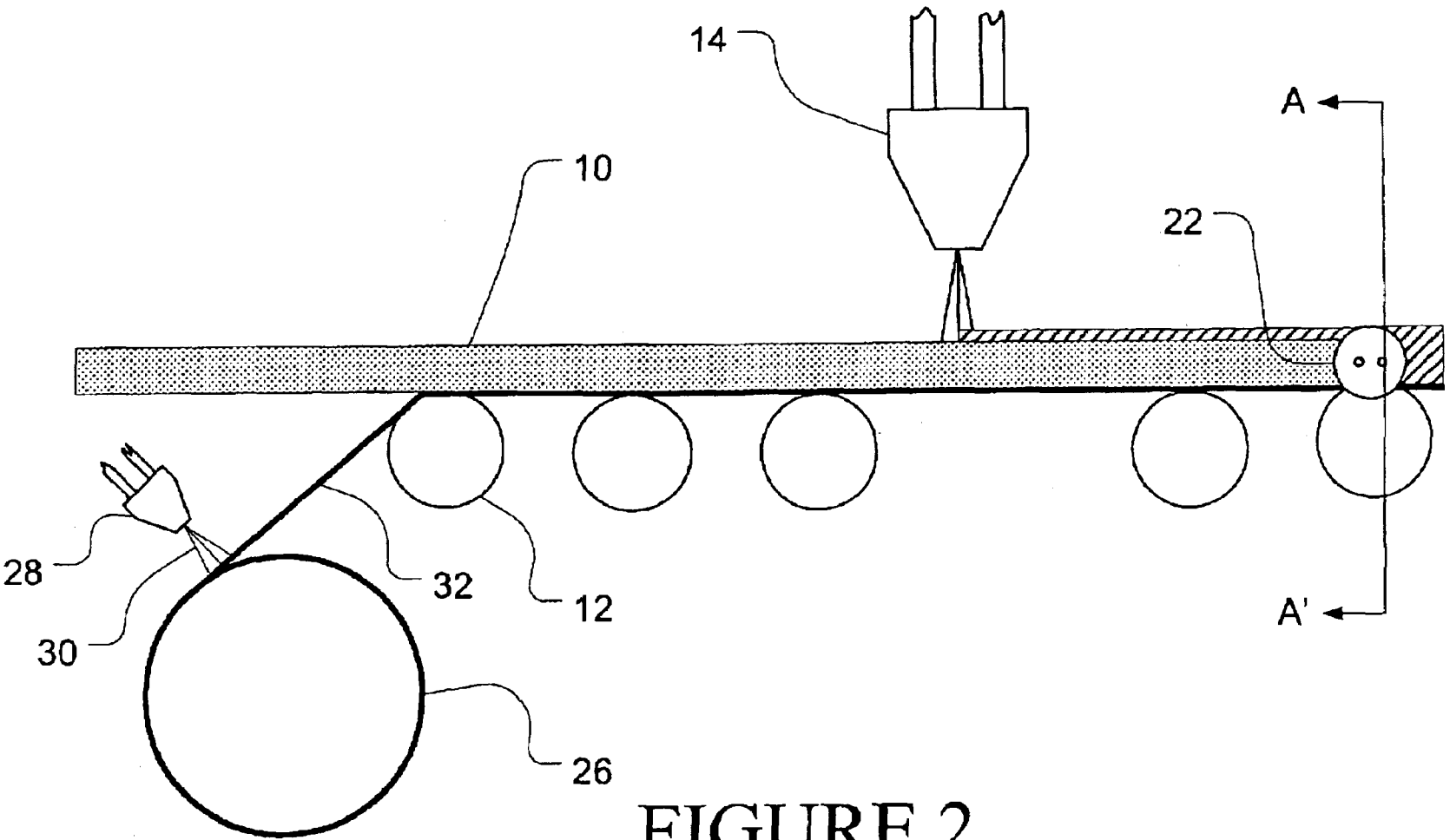
FIG. 2 is a side view illustrating certain components in a second embodiment of an apparatus for manufacturing an encapsulated fiber batt incorporating a vapor barrier layer.
Figure 3:
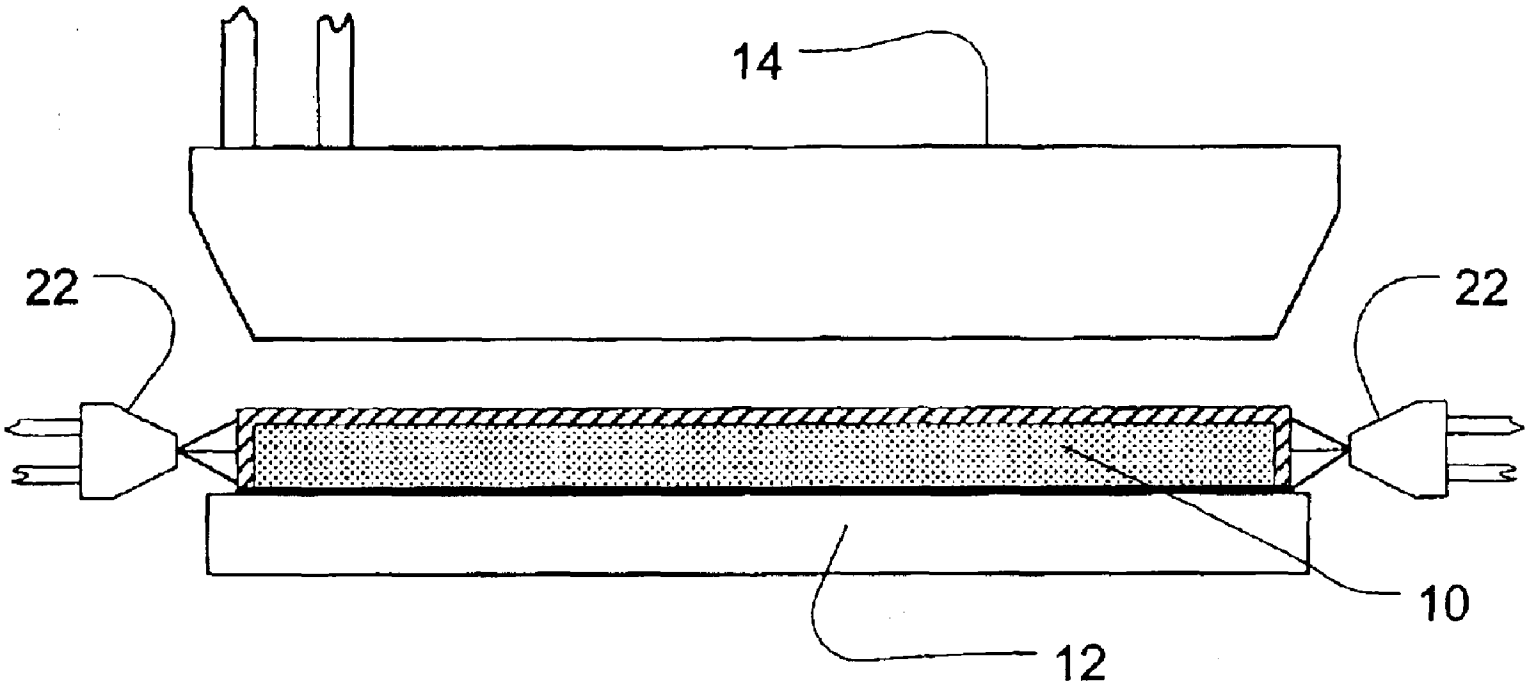
FIG. 3 is a cross-sectional view along line A–A' in FIG. 2 illustrating certain components in the second embodiment and the fully encapsulated fiber batt.

As illustrated in FIG. 2, in a second embodiment of the invention, the fiber batt 10 is moved past a playout stand or reel 26 from which a vapor retarder layer 32, preferably a polyethylene film, is removed. The vapor retarder layer 32 may then be coated with a discontinuous layer of an adhesive 30 from a spray head 28. If a hot melt adhesive is used, spray head 28 is preferably a hot melt spray head (or nozzle) to which molten adhesive and a blowing gas are supplied. The adhesive-coated vapor retarder layer is then applied to a surface of the fiber batt using a series of rollers 12 or belts (not illustrated) to adhere the vapor retarder layer to the fiber batt. The fiber batt with the attached vapor retarder layer is then moved past a series of melt blowing heads 14, 22 where a polymeric layer is applied to the remaining surfaces of the fiber batt and, optionally, to the surface of the vapor retarder layer to complete the manufacture of the insulation product. As illustrated in FIG. 3, representing a cross section at line A–A' in FIG. 2, the finished insulation product is fully encapsulated by the melt blown polymeric layer.

Figure 4A:
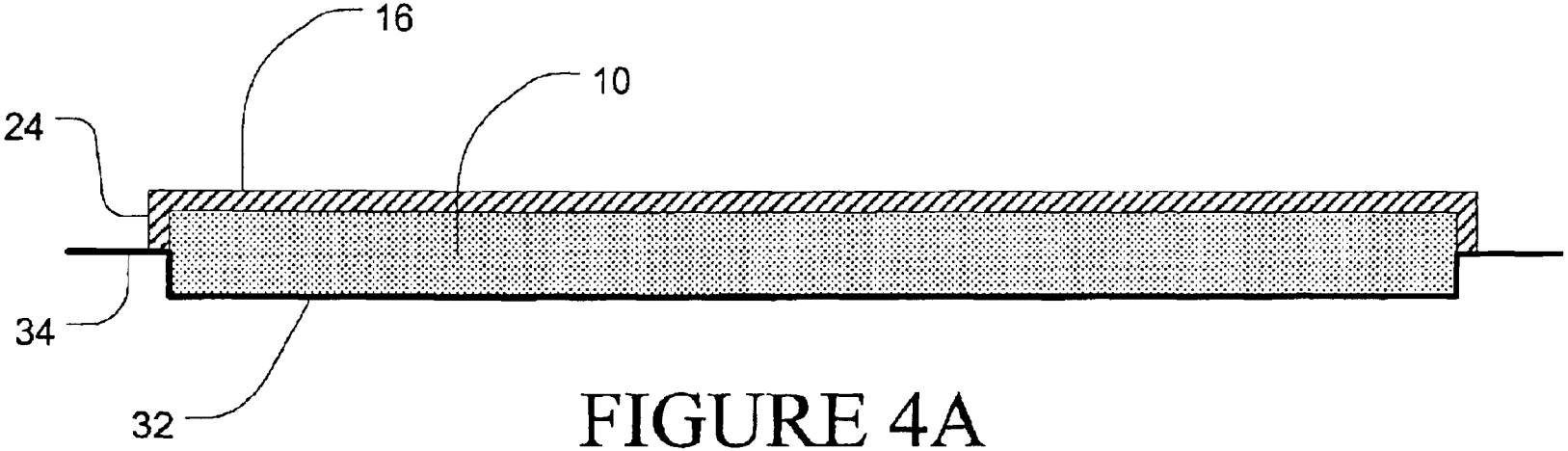
FIGS. 4A and 4B are a schematic perspective views of alternative insulation products that may be formed according to the present invention with modifications in the arrangement of the facing layer.
Figure 4B:
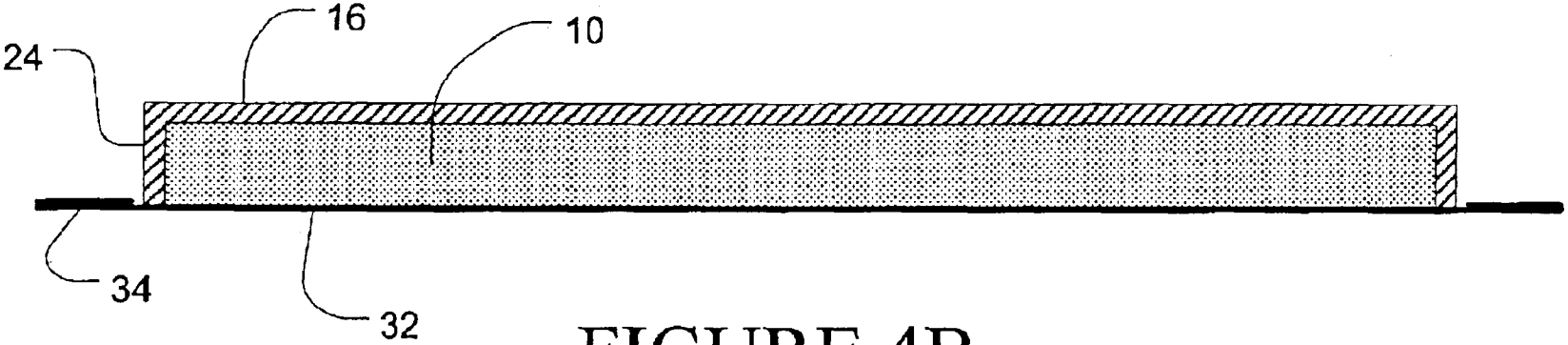

If a vapor retarder layer is applied, it is preferred that the vapor retarder layer be sized to be wider than the fiber batt so that excess film extends past the surface to which it is being applied by between about one and four inches (between about 2.5 and 10 cm) on each side of the fiber batt. This excess film may then be folded over and bonded together using glue, ultrasonic welding, or other fastening means to form two flanges useful during the installation of the insulation product. As illustrated in FIGS. 4A and 4B the vapor retarder layer may extend partially or completely along secondary (i.e., typically the side) surfaces and may be overlapped, to increase the mechanical strength or improve its appearance, or may be left as a single thickness flange.

The encapsulating layer is formed by depositing a thin layer of randomly oriented hot polymer fibers directly on the surface of the fiber batt. The spacing between the fiber batt and the melt blowing head is selected to ensure that the polymer fibers reach the surface of the fiber batt while they are still warm and tacky and will tend (1) to bond to one another to form the desired encapsulating layer, and (2) to adhere to the glass batt surface at a reasonable bonding strength so that the skin layer becomes an integral part of the product. The encapsulating layer is preferably relatively thin, ensuring that the fibers will cool very quickly even under ambient conditions and thereby avoid the need and expense associated with an additional cooling process.

Figure 5:
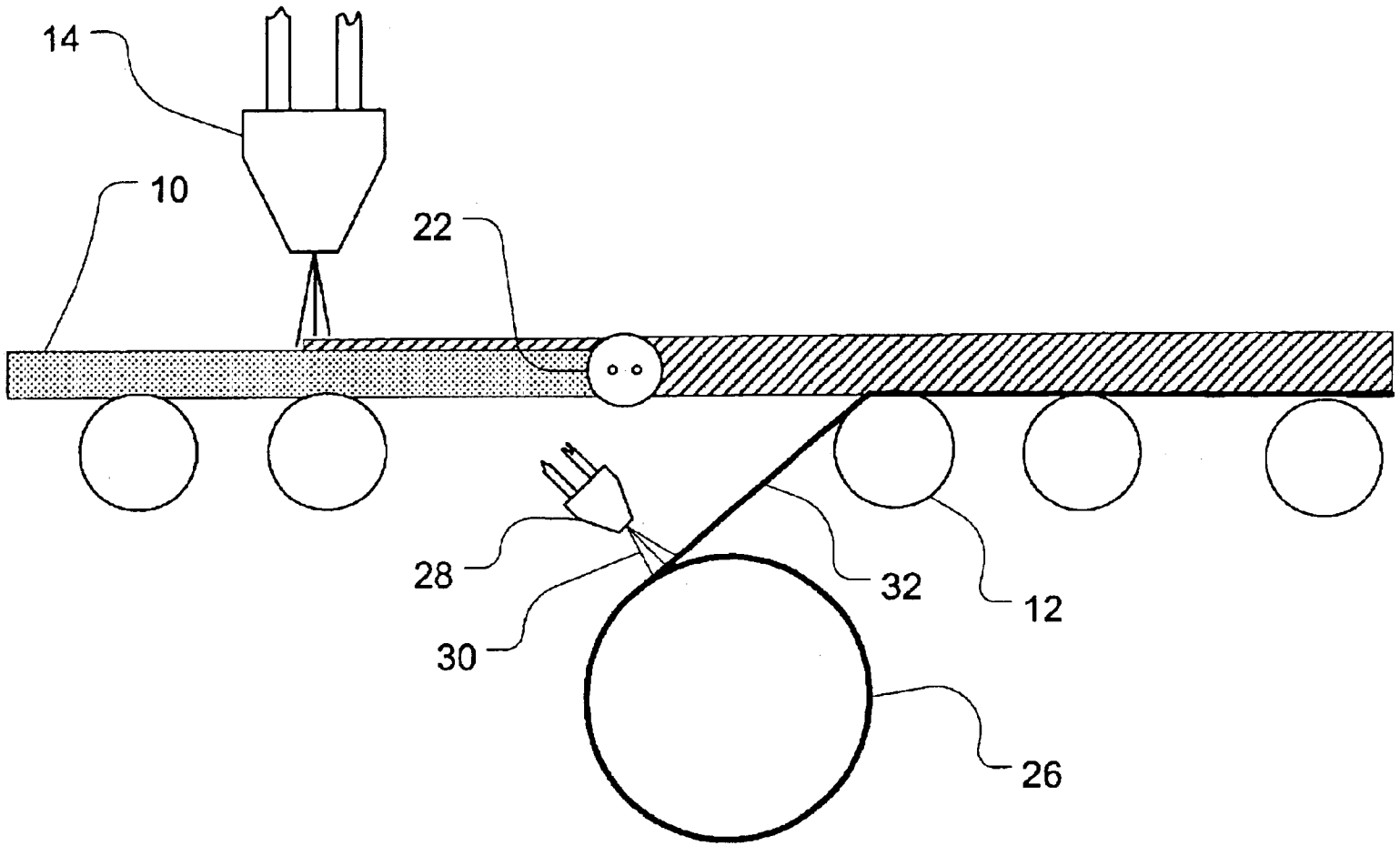
FIG. 5 is a side view illustrating certain components in a third embodiment of an apparatus for manufacturing an encapsulated fiber batt incorporating a vapor barrier layer.

As illustrated in FIG. 5, the basic apparatus of FIG. 2 can be modified to provide for the attachment of the vapor retarding layer 32 after the fiber batt 10 has been substantially encapsulated by the melt blown material(s) from the melt blowing heads 14 and 22.

Figure 6:
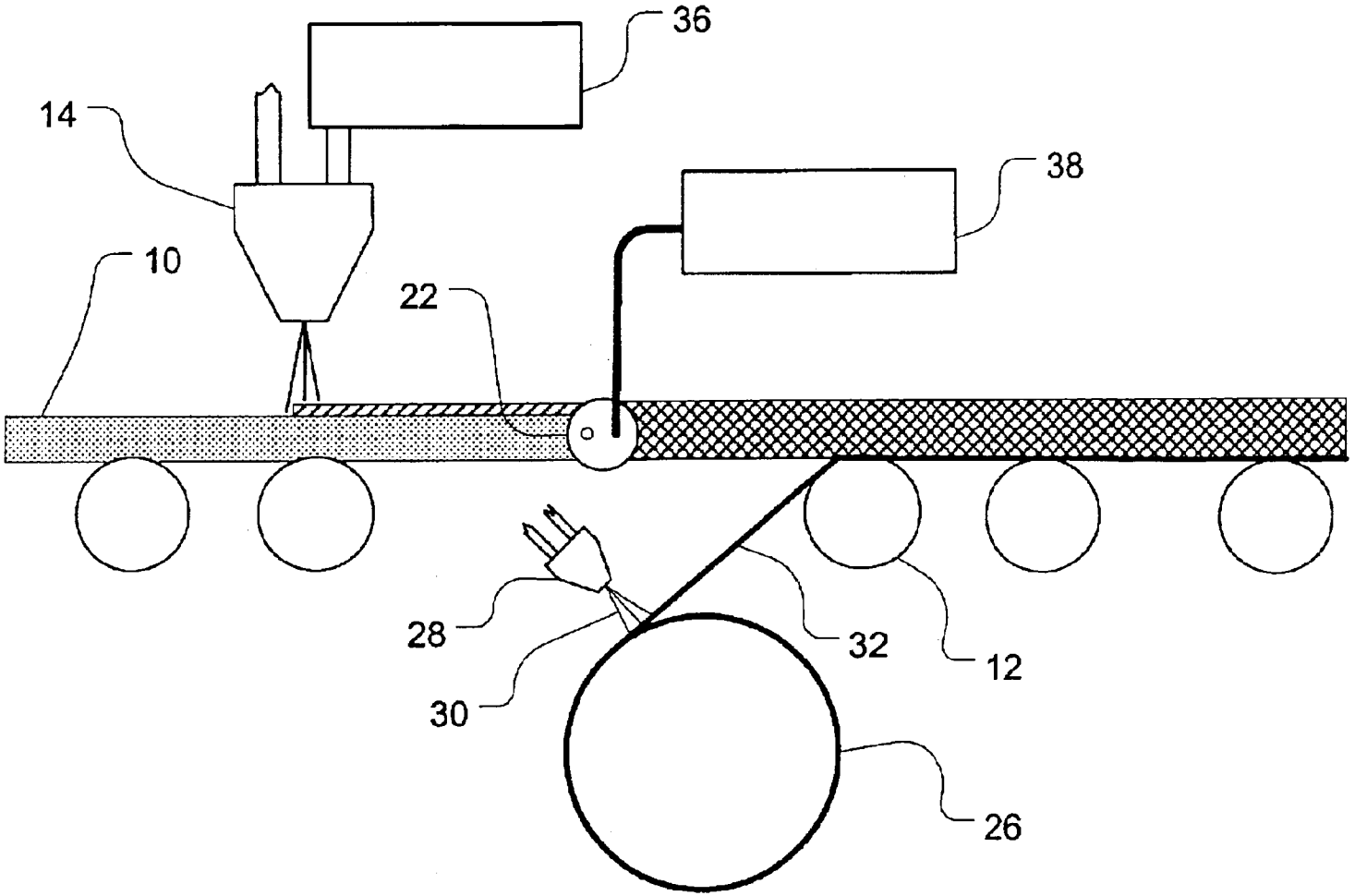
FIG. 6 is a side view illustrating certain components in a fourth embodiment of an apparatus for manufacturing an encapsulated fiber batt incorporating a vapor barrier layer.

As illustrated in FIG. 6, the present invention provides for the coating of different sides of the fiber batt 10 with different materials, allowing the properties and characteristics of the various sides of the batt to be selected independently. For example, the material selected for coating the major (i.e., top and bottom) surfaces can be selected from a first material supply 36 to provide a smooth, vapor retarding surface, while one or more of the minor surfaces (i.e., sides) may be coated with a material from a secondary material supply 38 so that they are left more porous (to aid in compressing the final product) and/or rough to aid in the manufacturing feeding processes or providing a better friction fit into the stud cavities during installation.

Figure 7A:
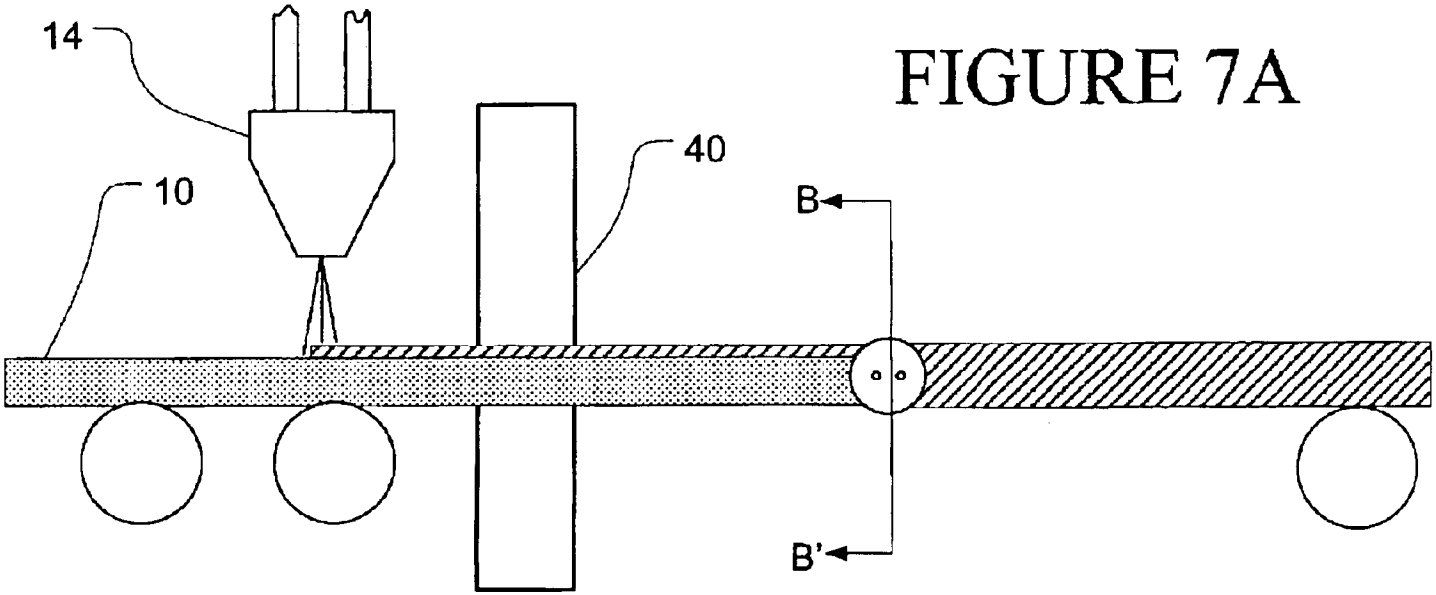
FIG. 7A is a side view of an apparatus for producing multiple fiber batts from a single larger batt and FIB. 7B is a cross sectional view along line B–B' of FIG. 7A
Figure 7B:
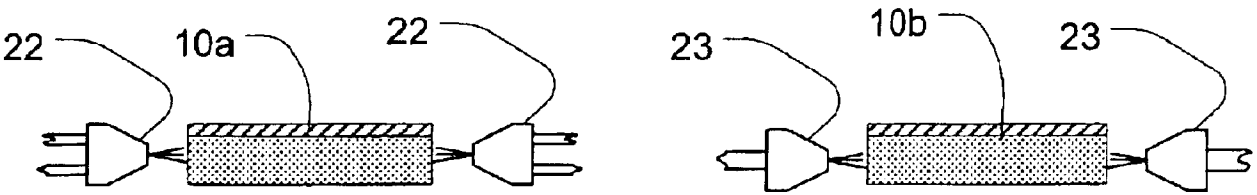
Figure 8:
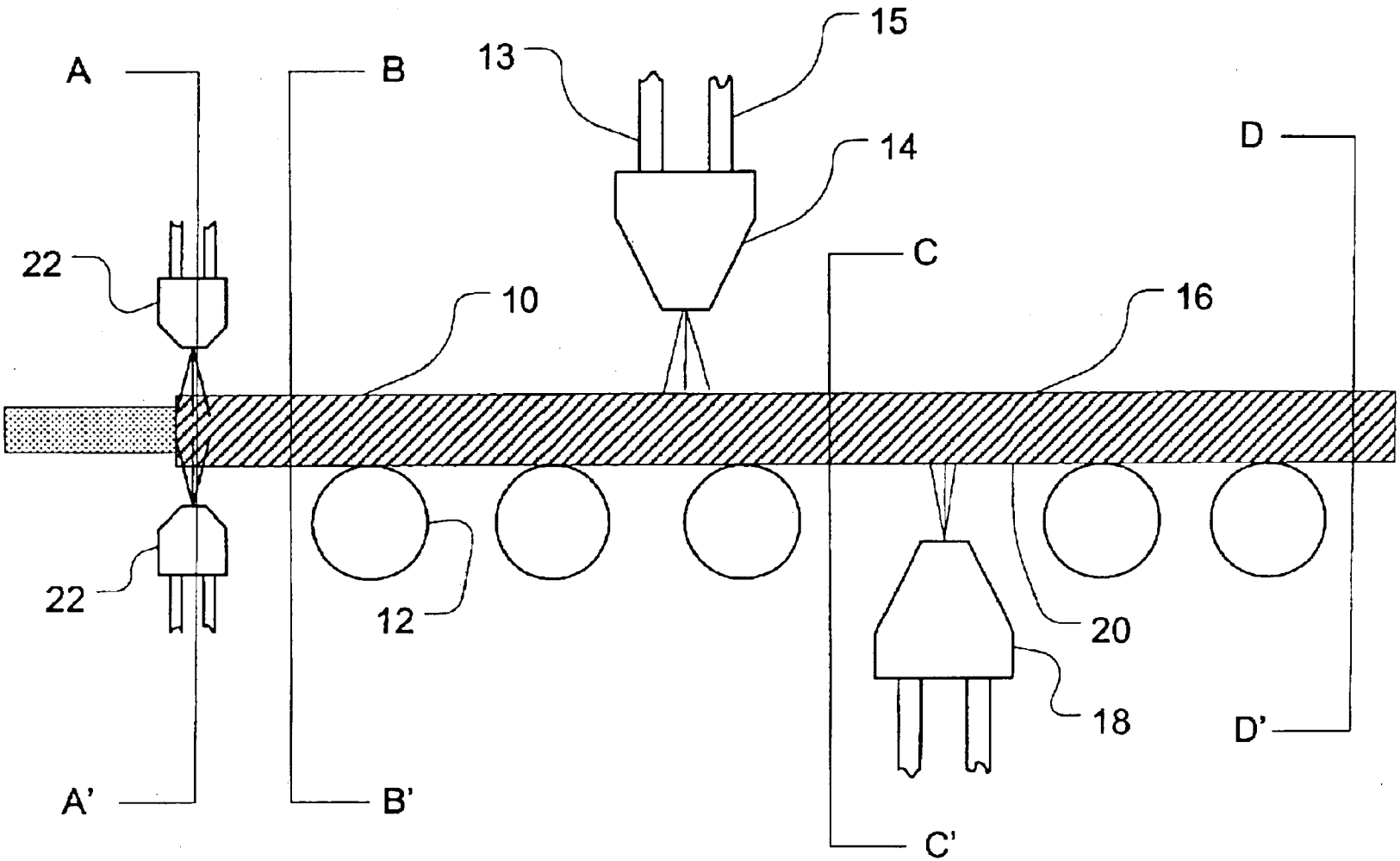
FIG. 8 is a side view of an alternative embodiment of an apparatus for encapsulating a fiber batt that provides for improved coverage at the corners of the fiber batt.
Figure 9A:
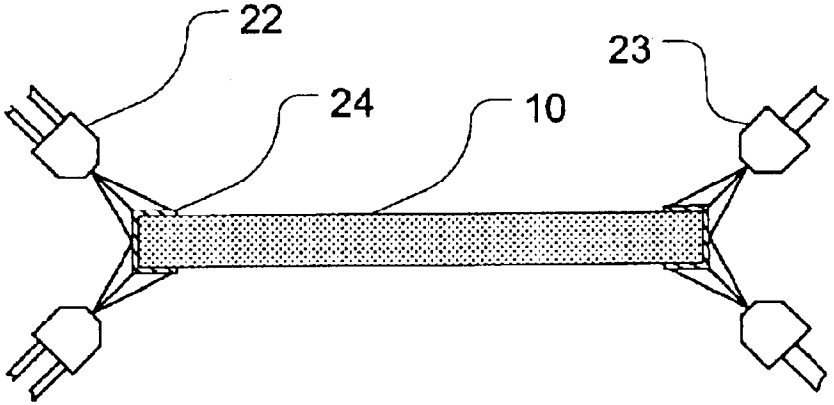
FIGS. 9A–D are cross-sectional views of FIG. 8 at lines A–A', B–B', C–C' and D–D' respectively illustrating the sequential coating of the fiber batt according to one embodiment of the present invention.
Figure 9B:
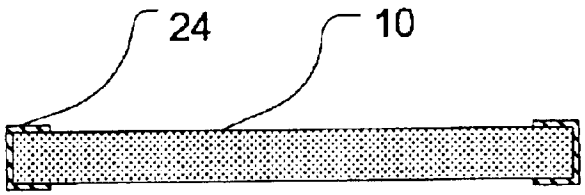
Figure 9C:
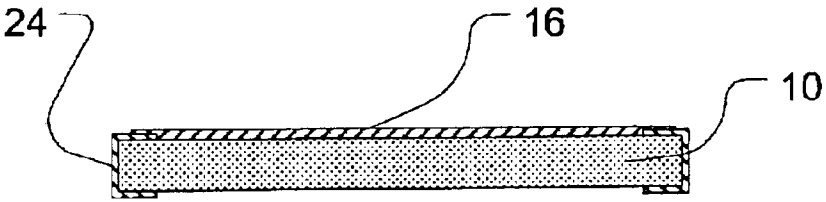
Figure 9D:
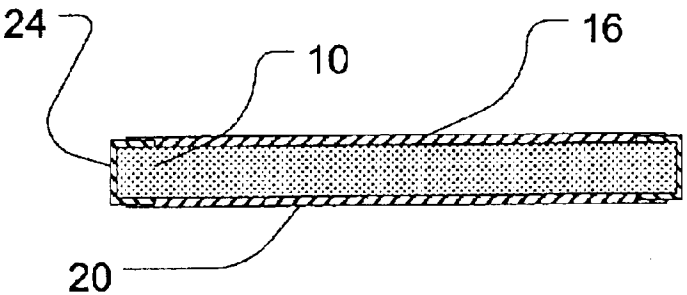

As illustrated in FIGS. 7A and 7B, although the previous discussion has focused on single fiber batt processes, the addition of a splitter 40 and additional melt blowing heads 22 and/or hot melt spray nozzles 23 for coating the newly formed side surfaces can provide for the production of multiple encapsulated fiber batts. Although only two fiber batts 10*a*, 10*b* are illustrated for simplicity, depending on the manufacturing space and the commercial need additional fiber batts of similar or different widths could be produced in a similar manner by adding and/or repositioning the splitter(s) and adding sufficient melt blowing heads to encapsulate the newly exposed surfaces of the fiber batts.

Similarly, the embodiment illustrated in FIG. 7A could be reconfigured to provide for coating of the lower surface of the fiber batt as illustrated in FIG. 1 and/or the addition of a vapor retarding layer to one or more of the surfaces, before or after the primary fiber batt has been split into the secondary fiber batts. These and other design choices regarding the sequence and degree of encapsulation, the inclusion of one or more vapor retarding layers, and the production of secondary fiber batts may be constructed by one of ordinary skill in the art as guided by this disclosure.

As illustrated in FIG. 8 and FIGS. 9A–D, an alternative embodiment of the invention provides for enhanced coverage of the corners of the fiber batt 10. In a preferred configuration, at least two melt blowing heads 22 or hot melt spray nozzles 23 are directed toward each of the minor surfaces of the fiber batt and oriented so that the resulting skin layer 24 covers both the minor surface and an edge portion of the major surfaces. Due in large part to their smaller size and simplicity when compared with melt-blowing heads 22, in some application hot melt spray nozzles 23 may be preferred for applying polymeric compositions to the minor or side edges of the fiber batt. This edge wrapping layer can then be combined with additional fiber coating layers of the same or different (illustrated) polymeric materials and/or vapor retarding layers (not illustrated) formed on one, FIG. 9C, or both, FIG. 9D, of the major surfaces to complete the fiber product.

Once the encapsulation layer has been formed and cooled, the encapsulated batt may be sent to a chopping station where the continuous glass fiber batt may be chopped into insulation products of various standard or custom lengths. The insulation product is then typically sent to a packaging station (e.g., a BRU or a bagger).

A series of trials were conducted according to the method detailed above using polypropylene from ExxonMobil Chemical, specifically PP3546G, with a MFI of 1200 grams per 10 minutes, 80% between 25–35 mesh; 0 at 200 mesh; and a typical manufacturing temperature of 470–515° F. (243–268° C.) as the polymeric material. The fiber batt was R19 fiberglass having a thickness of 6.5 inches (16.5 cm) and a width of approximately 15 inches (38 cm) and a length of approximately 20 feet (6.1 m). This fiber batt was then passed under a melt blowing head having 35 holes per inch (approximately 14 holes per cm) through which the molten polypropylene was ejected and fiberized to form polypropylene fibers having diameters of approximately 4–6 $\mu$m, while varying the speed of the fiber batt and the flowrate of the polymeric material according to the data provided below in Table 1 to produce a melt blown encapsulating web layers of varying weight.

TABLE 1

| Example | Fiber Batt Line speed m/min | Polymer Flowrate g/hole/min | Layer Weight g/m$^2$ |
|---|---|---|---|
| 1 | 27.5 | 0.4 | 20.04 |
| 2 | 55.0 | 0.4 | 10.02 |
| 3 | 76.0 | 1.0 | 18.13 |
| 4 | 54.8 | 1.0 | 25.15 |

EXAMPLE 5

Twenty-foot (6.1 m) long and 15" (38 cm) wide R-19 fiber batt was used. The first major surface (top) was coated with melt-blown polypropylene fibers at a rate of about 20 grams/m$^2$ using the same conditions as indicated above for Example 1 and the two minor (side) surfaces were coated with polypropylene fibers sprayed from small hot melt nozzles at a rate of about 20 grams/m$^2$. A vapor retarding layer, specifically a 1.0 mil (25.4 $\mu$m) thick polyethylene film, was then bonded to the remaining major surface (bottom) using a pressure sensitive hot melt adhesive (Evans Adhesive Corporation, Columbus, Ohio, product # 07505). The adhesive was applied as 3 continuous stripes, one at center and two along the edges. Each stripe was about 1 inch (2.5 cm) wide, and the glue application rate for each stripe was about 0.2 grams per linear foot (0.65 grams/meter). The resulting product was a faced fiber batt insulation material having a non-woven polypropylene fiber layer on the remaining surfaces for improved handleability and reduced fiber and dust generation.

EXAMPLE 6

Twenty-foot (6.1 m) long and 15" (38 cm) wide R-19 batt was used. The two major surfaces (top and bottom) were covered, with a melt blown polypropylene coating applied at a rate of about 20 grams/m$^2$ using the same condition as indicated above for Example 1. The two side surfaces were then spray coated with an EVA polymer (Henkel, product # 80-8330) using small hot melt nozzles. Each of the side surfaces was about 6.5" (16.5 cm) wide (R19 batt thickness), and the EVA application rate was about 1.3 grams per linear foot for a coating weight of about 2.4 grams/ft$^2$ (25.8 grams/M$^2$). The resulting product was a faced fiber batt insulation material having an encapsulating layer of a non-woven polymeric fibers alternating between regions of polypropylene and EVA, illustrating the ability to "tune" the encapsulating layers on various surfaces to customize the appearance and performance of the resulting insulation product while improving handleability and reducing fiber and dust generation.

The principle and mode of operation of this invention have been described in its preferred embodiments. However, it should be noted that this invention may be practiced otherwise than as specifically illustrated and described without departing from its scope.

I claim:

1. A method for manufacturing an encapsulated fiber batt comprising the steps of:

conveying a fiber batt in a first direction, the fiber batt having n surfaces;

providing a molten polymeric material and a blowing gas to a plurality of melt blowing heads, at least one melt blowing head being arranged adjacent each of the n surfaces of the fiber batt;

forming a plurality of polymeric filaments by ejecting a stream of the molten polymeric material from a first opening provided in each of the melt blowing heads toward the surface of the fiber batt adjacent each of the melt blowing heads;

forming a plurality of hot polymeric fibers by contacting each of the polymeric filaments with a gas stream of the blowing gas from a second opening provided in each of the melt blowing heads, the velocity, volume and direction of the gas stream acting to attenuate and separate portions of the polymeric filaments, the hot polymeric fibers having a diameter of between about 1 and about 9 microns;

accumulating a randomly oriented layer of the hot polymeric fibers on each of the n surfaces of the fiber batt, the temperature of the hot polymeric fibers reaching each of the n surfaces of the fiber batt being sufficient to induce fiber-to-fiber adhesion between the hot polymeric fibers; and cooling the layers of hot polymeric fibers to form a substantially continuous nonwoven polymeric skin layer on each of the is surfaces of the fiber batt and thereby encapsulate the fiber batt;

wherein:

the fiber batt comprises first and second major surfaces and first and second minor surfaces;

and further wherein:

the substantially continuous nonwoven polymeric skin layer formed on the first major surface has a substantially different weight per unit area than the substantially continuous nonwoven polymeric skin layer formed on the second major surface or the substantially continuous nonwoven polymeric skin formed on the first and second minor surfaces.

2. A method for manufacturing an encapsulated fiber batt according to claim 1, wherein:

the ratio of the weight per unit area of the polymeric skin layer on the first major surface to the weight per unit area of the polymeric skin layer on the second major surface is at least 2:1.

3. A method for manufacturing an encapsulated fiber batt according to claim 1, wherein:

the ratio of the weight per unit area of the polymeric skin layer on the first minor surface to the weight per unit area of the polymeric skin layer on the second minor surface is about 1:1 the ratio of the weight per unit area of the polymeric skin layer on the first major surface to the weight per unit area of the polymeric skin layer on the first minor surface is from about 3:1 to 1:3.

4. A method for manufacturing an encapsulated fiber batt comprising the steps of:

conveying a fiber batt in a first direction, the fiber batt having n surfaces;

providing a molten polymeric material and a blowing gas to a plurality of melt blowing heads, at least one melt blowing head being arranged adjacent each of the n surfaces of the fiber batt;

forming a plurality of polymeric filaments by ejecting a stream of the molten polymeric material from a first opening provided in each of the melt blowing heads toward the surface of the fiber batt adjacent each of the melt blowing heads;

forming a plurality of hot polymeric fibers by contacting each of the polymeric filaments with a gas stream of the blowing gas from a second opening provided in each of the melt blowing heads, the velocity, volume and direction of the gas stream acting to attenuate and separate portions of the polymeric filaments, the hot polymeric fibers having a diameter of between about 1 and about 9 microns;

accumulating a randomly oriented layer of the hot polymeric fibers on each of the n surfaces of the fiber batt, the temperature of the hot polymeric fibers reaching each of the n surfaces of the fiber batt being sufficient to induce fiber-to-fiber adhesion between the hot polymeric fibers; and cooling the layers of hot polymeric fibers to form a substantially continuous nonwoven polymeric skin layer on each of the n surfaces of the fiber batt and thereby encapsulate the fiber batt;

wherein:

the fiber batt comprises first and second major surfaces and first and second minor surfaces;

and further wherein:

the polymeric skin layers formed on the first and second major surfaces consist essentially of a first polymeric material; and the polymeric skin layers formed on the first and second minor surfaces consist essentially of a second polymeric material, the first and second polymeric materials comprising different polymeric materials.

5. A method for manufacturing a partially encapsulated fiber batt comprising the steps of:

conveying a fiber batt in a first direction, the fiber batt having two major surfaces and two minor surfaces;

providing a first molten polymeric material and a blowing gas to a plurality of melt blowing heads, at least two melt blowing heads being arranged adjacent each of the minor surfaces;

forming a plurality of polymeric filaments by ejecting a stream of the first molten polymeric material from a first opening provided in each of the melt blowing heads toward the surface of the fiber batt adjacent each of the melt blowing heads;

forming a plurality of hot polymeric fibers by contacting each of the polymeric filaments with a gas stream of the blowing gas from a second opening provided in each of the melt blowing heads, the velocity, volume and direction of the gas stream acting to attenuate and separate portions of the polymeric filaments, wherein the melt blowing heads are arranged at an offset angle relative to a plane defined by an adjacent major surface and positioned to direct the hot polymeric fibers toward an edge formed between the adjacent major surface and an adjacent minor surface along an axis substantially parallel to the offset angle;

accumulating a layer of the hot polymeric fibers on each of the minor surfaces and on edge portions of the major surfaces adjacent the minor surfaces, the hot polymeric fibers being randomly oriented and of sufficient temperature to produce fiber-to-fiber adhesion between the hot polymeric fibers as they accumulate; and cooling the layers of hot polymeric fibers to form a nonwoven polymeric skin region covering the minor surfaces and extending onto edge portions of the major surfaces.

6. A method for manufacturing a partially encapsulated fiber batt according claim 1, further comprising the steps of:

providing a second molten polymeric material to an outlet head arranged adjacent a first major surface of the fiber batt;

forming an additional polymeric filament by ejecting a stream of the second molten polymeric material from a first opening provided in the outlet head toward the first major surface of the fiber batt adjacent the outlet head;

forming a plurality of hot polymeric fibers by attenuating and separating portions of the additional polymeric filament;

accumulating a layer of the hot polymeric fibers on the first major surface, the hot polymeric fibers being randomly oriented and of sufficient temperature to produce fiber-to-fiber adhesion between the hot polymeric fibers as they accumulate; and cooling the layers of hot polymeric fibers to form a nonwoven polymeric skin region covering the first major surface and form, in cooperation with the nonwoven polymeric skin layer on the minor surfaces, a substantially continuous nonwoven polymeric skin layer on the first major surface and the minor surfaces.

7. A method for manufacturing a partially encapsulated fiber batt according claim 6, further comprising the steps of:

providing a third molten polymeric material and a blowing gas to a second additional melt blowing head arranged adjacent a second major surface of the fiber batt;

forming a second additional polymeric filament by ejecting a stream of the third molten polymeric material from a first opening provided in the second additional melt blowing head toward the second major surface of the fiber batt adjacent the second additional melt blowing head;

forming a plurality of hot polymeric fibers by contacting the second additional polymeric filament with a gas stream of the blowing gas from a second opening provided in the second additional melt blowing head, the velocity, volume and direction of the gas stream acting to attenuate and separate portions of the second additional polymeric filament;

accumulating a layer of the hot polymeric fibers on the second major surface, the hot polymeric fibers being randomly oriented and of sufficient temperature to produce fiber-to-fiber adhesion between the hot polymeric fibers as they accumulate; and cooling the layers of hot polymeric fibers to form a nonwoven polymeric skin region covering the second major surface and to form, in cooperation with the nonwoven polymeric skin layer on the first major surface and minor surfaces, a substantially continuous nonwoven polymeric skin layer encapsulating the fiber batt.

8. A method for manufacturing an encapsulated fiber batt according claim 7, wherein:

the first and third polymeric materials comprise substantially the same polymeric material and the second polymeric material comprises a different polymeric material.

9. A method for manufacturing an encapsulated fiber batt according claim 8, wherein:

the first and third polymeric materials comprise polypropylene and the second polymeric material comprises EVA.

10. A method for manufacturing an encapsulated fiber batt according claim 6, wherein forming a plurality of hot polymeric fibers by attenuating and separating portions of the additional polymeric filament further comprises:

ejecting the second polymeric material and a gas from a hot melt nozzle.

11. A method for manufacturing an encapsulated fiber batt according claim 6, wherein forming a plurality of hot polymeric fibers by attenuating and separating portions of the additional polymeric filament further comprises:

contacting the additional polymeric filament with a blowing gas stream issuing from a second opening provided in the outlet head, the velocity, volume and direction of the blowing gas stream acting to attenuate and separate portions of the second additional polymeric filament.

* * * * *

UNITED STATES PATENT AND TRADEMARK OFFICE

CERTIFICATE OF CORRECTION

PATENT NO. : 6,905,563 B2
DATED : June 14, 2005
INVENTOR(S) : Dong

It is certified that error appears in the above-identified patent and that said Letters Patent is hereby corrected as shown below:

Column 8,
Line 50, "is" should be "n".

Signed and Sealed this

Eighteenth Day of April, 2006

JON W. DUDAS
*Director of the United States Patent and Trademark Office*